US011408364B2

(12) United States Patent
Saint-Macary

(10) Patent No.: US 11,408,364 B2
(45) Date of Patent: Aug. 9, 2022

(54) METHOD FOR REGULATING THE OUTPUT VOLTAGE OF A DC/DC VOLTAGE CONVERTER OF A CONTROL COMPUTER OF A MOTOR VEHICLE ENGINE

(71) Applicants: CONTINENTAL AUTOMOTIVE FRANCE, Toulouse (FR); CONTINENTAL AUTOMOTIVE GMBH, Hannover (DE)

(72) Inventor: Stéphane Saint-Macary, Toulouse (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 16/956,125

(22) PCT Filed: Dec. 11, 2018

(86) PCT No.: PCT/FR2018/053190
§ 371 (c)(1),
(2) Date: Jun. 19, 2020

(87) PCT Pub. No.: WO2019/122593
PCT Pub. Date: Jun. 27, 2019

(65) Prior Publication Data

US 2020/0325842 A1 Oct. 15, 2020

(30) Foreign Application Priority Data

Dec. 21, 2017 (FR) ..... 1762725

(51) Int. Cl.
*F02D 41/20* (2006.01)

(52) U.S. Cl.
CPC ..... *F02D 41/20* (2013.01); *F02D 2041/2006* (2013.01); *F02D 2041/2048* (2013.01); *F02D 2041/2068* (2013.01)

(58) Field of Classification Search
CPC ..... F02D 41/20; F02D 41/30; F02D 41/3005; F02D 2041/2006; F02D 2041/2068; F02D 2041/2048; F02M 51/06; F02M 51/0625
(Continued)

(56) References Cited

U.S. PATENT DOCUMENTS 5,477,831 A * 12/1995 Akaki ..... H02N 2/067 123/490
8,018,216 B2 * 9/2011 Kakehi ..... F02D 41/20 323/288

(Continued)

FOREIGN PATENT DOCUMENTS

CN 103807041 A 5/2014
CN 104575933 A 4/2015

(Continued)

OTHER PUBLICATIONS

International Search Report, PCT/FR2018/053190, dated Mar. 25, 2019.

(Continued)

*Primary Examiner* — John Kwon
*Assistant Examiner* — Johnny H Hoang
(74) *Attorney, Agent, or Firm* — Nixon & Vanderhye

(57) ABSTRACT

Disclosed is a method for regulating the output voltage of a DC-to-DC voltage converter of a motor vehicle engine control computer. The method includes a step of the microcontroller simultaneously controlling a control module, so that the control module drives at least one injector of the vehicle engine, and a converter, so that the converter generates its own output voltage by setting the strength of the
(Continued)

drive current to its maximum in what is called a "forced" mode corresponding to a step.

16 Claims, 3 Drawing Sheets

(58) Field of Classification Search
USPC ..... 123/478–481, 490; 701/102–105
See application file for complete search history.

(56) References Cited

U.S. PATENT DOCUMENTS

| | | | | |
|---|---|---|---|---|
| 10,087,870 | B2 | 10/2018 | Imai et al. | |
| 10,100,769 | B2 | 10/2018 | Maase et al. | |
| 10,450,995 | B2 | 10/2019 | Kimura et al. | |
| 10,634,084 | B2 | 4/2020 | Imai et al. | |
| 2005/0030691 | A1* | 2/2005 | Bolz | F02D 41/20 361/152 |
| 2010/0085784 | A1* | 4/2010 | Chou | H02M 1/14 363/45 |
| 2010/0283521 | A1* | 11/2010 | Barroso | H02M 1/14 327/164 |
| 2015/0101575 | A1 | 4/2015 | Maase et al. | |
| 2015/0267662 | A1* | 9/2015 | Nehl | F02M 51/005 123/294 |
| 2018/0023503 | A1* | 1/2018 | Kimura | F02D 41/402 701/104 |
| 2018/0045133 | A1 | 2/2018 | Denk | |
| 2018/0230924 | A1* | 8/2018 | Tanaka | F02D 41/20 |

FOREIGN PATENT DOCUMENTS

| | | | |
|---|---|---|---|
| CN | 107061034 | A | 8/2017 |
| CN | 107110048 | A | 8/2017 |
| CN | 107532536 | A | 1/2018 |
| EP | 2015431 | | 1/2009 |
| WO | WO2016-125688 | | 8/2016 |

OTHER PUBLICATIONS

Office Action issued in Chinese Patent Application No. 201880082690.6 dated Dec. 13, 2021.

* cited by examiner

METHOD FOR REGULATING THE OUTPUT VOLTAGE OF A DC/DC VOLTAGE CONVERTER OF A CONTROL COMPUTER OF A MOTOR VEHICLE ENGINE

BACKGROUND OF THE INVENTION

Field of the Invention

The present invention pertains to the field of fuel injection and relates more particularly to a method for regulating the output voltage of a DC-to-DC voltage converter of a motor vehicle engine control computer and to such a computer.

Description of the Related Art

In a motor vehicle with a thermal combustion engine, fuel injection is controlled by a control computer commonly known as an electronic control unit or ECU.

FIG. 1 schematically shows one example of a vehicle 1A of an existing solution. In this solution, the vehicle 1A comprises a supply battery 10A, an engine 20A and a computer 30A.

The role of the supply battery 10A is to supply power to auxiliary electrical equipment (not shown) of the vehicle 1A.

The engine 20A is a thermal combustion engine comprising a set of cylinders (not shown) in each of which a mixture of fuel and gas is burned in order to drive the engine 20A, the fuel being injected into the cylinders by a set of injectors 210A.

The computer 30A comprises a microcontroller 300A, a DC-to-DC converter 310A, commonly called DC-to-DC, and a control module 320A, commonly called "driver".

The converter 310A, which is a "boost" converter, comprises a conversion module 310A-1 configured so as to increase the value of the voltage delivered by the supply battery 10A, for example 12 V, to a higher output voltage value $V_S$ called "target voltage", for example 60 V, defined across the terminals of what is called an "intermediate" capacitor $C_S$ connected between the converter 310A and the control module 320A.

The microcontroller 300A controls the control module 320A by way of control signals. More precisely, the microcontroller 300A sends the control module 320A control signals for one or more injectors of the set of injectors 210A indicating the injection time. Upon receiving a control signal, the control module 320A then drives the injector(s) of the set of injectors 210A so as to inject fuel into the cylinders of the engine 20A.

The injectors of the set of injectors 210A are driven by the control module 320A from a discharge current from the intermediate capacitor C. Therefore, when one or more injectors of the set of injectors 210A is or are controlled, the intermediate capacitor $C_S$ discharges until the end of the injection, thereby causing the output voltage $V_S$ of the converter 310A to drop.

In order to recharge the intermediate capacitor $C_S$, it is then necessary to wait a significantly long time for the converter 310A to again supply the target voltage at output, thereby possibly disrupting the injection and therefore exhibiting a drawback.

In order to partially rectify this drawback, it is known to implement a current loop, via a regulation module 310A-2 connected between the output and the input of the converter 310A, that is to say at the terminals of the conversion module 310A-1. Such a loop makes it possible to detect the drop in the output voltage $V_S$ of the converter 310A in order to compensate it as and when said drop takes place.

The drop in the output voltage $V_S$ of the converter 310A will however be detected after a latency time starting at the time when the injector(s) of the set of injectors 210A is (are) controlled and ending after the current loop has observed the start of the voltage drop.

FIG. 2 shows the simultaneous temporal evolution of several variables: the amplitude of the injection current the times IT at which the injection current is controlled, the output voltage $V_S$ across the terminals of the intermediate capacitor $C_S$ and the amplitude of the regulation current $I_{peak}$ flowing between the regulation module 310A-2 and the conversion module 310A-1. It may be seen that each triangular current wave transmitted to the control module 320A causes the output voltage $V_S$ to drop and that the rise in current of the regulation current $I_{peak}$ to its maximum takes place linearly during a latency time. As a result, the output voltage $V_S$ drops to a relatively low value before returning to the value of the target voltage. This latency time therefore causes a delay that does not allow the output voltage $V_S$ of the converter 310A to be compensated quickly enough to prevent it from dropping to a relatively low value. Now, such a voltage drop requires a long time for the output voltage $V_S$ of the converter 310A to return to the value of the target voltage, thereby exhibiting a major drawback. There is therefore a need to at least partially rectify these drawbacks.

SUMMARY OF THE INVENTION

To this end, the invention first of all relates to a method for regulating the output voltage of a DC-to-DC voltage converter of a motor vehicle engine control computer, said computer comprising a microcontroller, a DC-to-DC voltage converter and a control module, said converter being configured so as to convert a DC voltage delivered by a supply battery of the vehicle into a DC output voltage of higher value and to regulate said output voltage through a current loop whose current varies between a minimum value and a maximum value in what is called a "regulation" mode. Said method is noteworthy in that it comprises a step of the microcontroller simultaneously controlling the control module, so that said control module drives at least one injector, and the converter, so that said converter generates its own output voltage by setting the strength of the regulation current to its maximum in what is called a "forced" mode.

The method according to the invention thus makes it possible to compensate the output voltage of the converter with a maximum regulation current as soon as the injectors are controlled by the control module, such that the drop in said output voltage is limited and that it is able to return quickly to the target voltage value.

In one embodiment, the control operation comprises a step of the microcontroller simultaneously sending a control signal to the control module, so that said control module drives at least one injector, and an activation signal to the converter so that said converter switches to the forced mode.

Preferably, the reception of the activation signal by the converter triggers the switching of a switch in order to switch the converter from the regulation mode to the forced mode. Specifically, a switch is a both simple and effective way to switch between the regulation mode and the forced mode.

According to one aspect of the invention, the method furthermore comprises a step of the microcontroller sending a deactivation signal to the converter so that said converter switches from the forced mode to the regulation mode, preferably when the output voltage of the converter has returned to a predetermined target value.

Preferably, the reception of the deactivation signal by the converter triggers the switching of a switch in order to switch the converter from the forced mode to the regulation mode.

The invention also relates to a motor vehicle engine control computer, said computer comprising a microcontroller, a DC-to-DC voltage converter and a control module, said converter being configured so as to convert a DC voltage delivered by a supply battery of the vehicle into a DC output voltage of higher value and to regulate said output voltage through a current loop whose current varies between a minimum value and a maximum value in what is called a "regulation" mode. Said computer is noteworthy in that the microcontroller is configured so as to simultaneously control the control module, so that said control module drives at least one injector, and the converter, so that said converter generates its own output voltage by setting the strength of the regulation current to its maximum in what is called a "forced" mode.

In one embodiment, the microcontroller is configured so as to simultaneously send a control signal to the control module, so that said control module drives at least one injector, and an activation signal to the converter so that said converter switches to the forced mode.

Advantageously, the microcontroller is configured so as to send a deactivation signal to the converter so that said converter switches from the forced mode to the regulation mode.

Preferably, the converter comprises a switch, preferably a two-position switch, configured so as to switch between the regulation mode and the forced mode, the microcontroller being configured so as to control said switch so that the converter switches between the regulation mode and the forced mode.

The invention relates lastly to a motor vehicle comprising a computer as presented above.

BRIEF DESCRIPTION OF THE DRAWINGS

Other features and advantages of the invention will become apparent from the description that follows, which is provided with reference to the appended figures, which are provided by way of non-limiting example and in which identical reference signs are assigned to similar objects.

DESCRIPTION OF THE PREFERRED EMBODIMENTS

The computer according to the invention is a control computer intended to be installed in a motor vehicle with a thermal combustion engine in order to control the injection of fuel into the cylinders of said engine.

Figure 1:
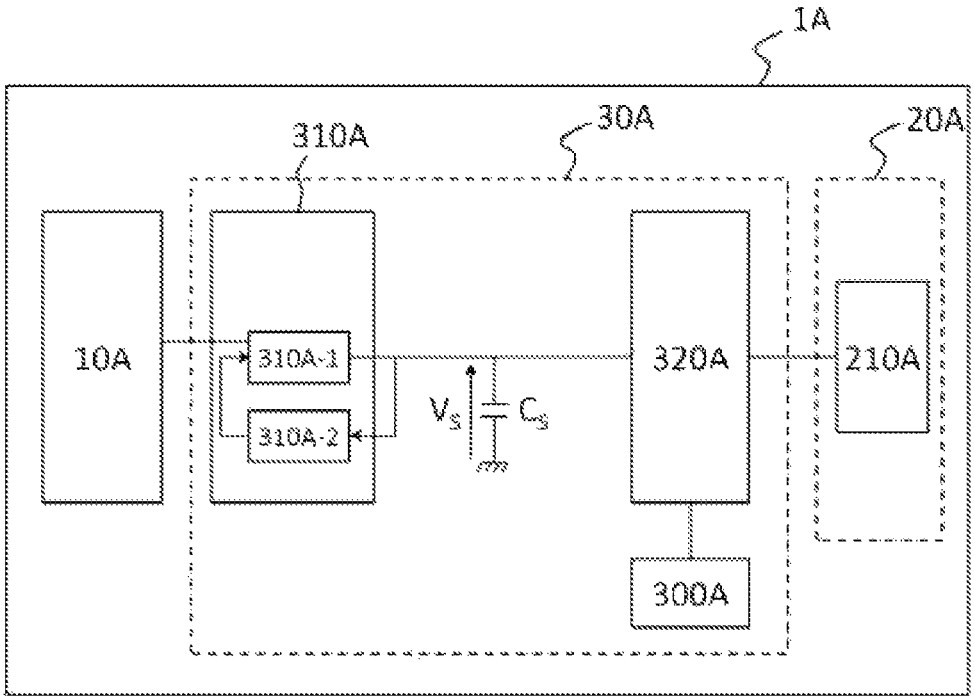
FIGURE 1 (Prior Art)
FIG. 1 schematically illustrates one embodiment of the vehicle from the prior art.
Figure 2:
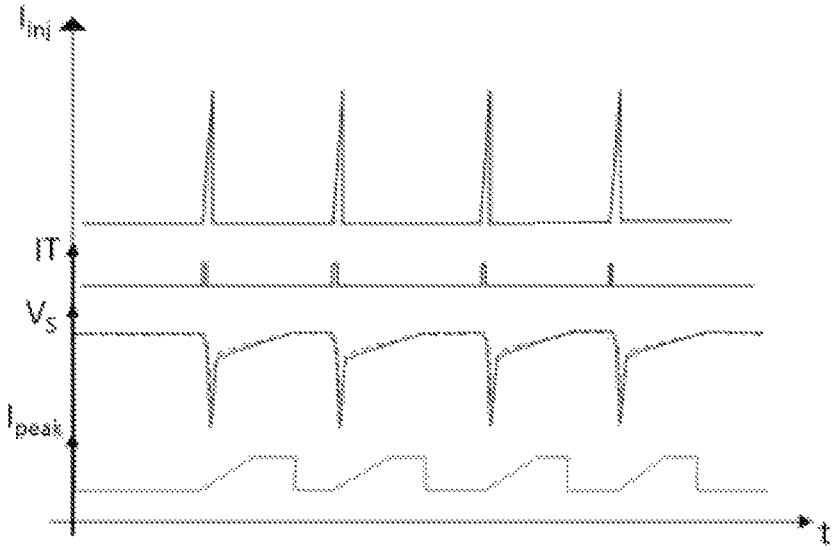
FIG. 2 graphically illustrates an example of the temporal evolution of the amplitude of the injection current, of the control times of the injection current, of the output voltage across the terminals of the intermediate capacitor and of the amplitude of the regulation current of a converter in an engine control computer of the vehicle of FIG. 1.
Figure 3:
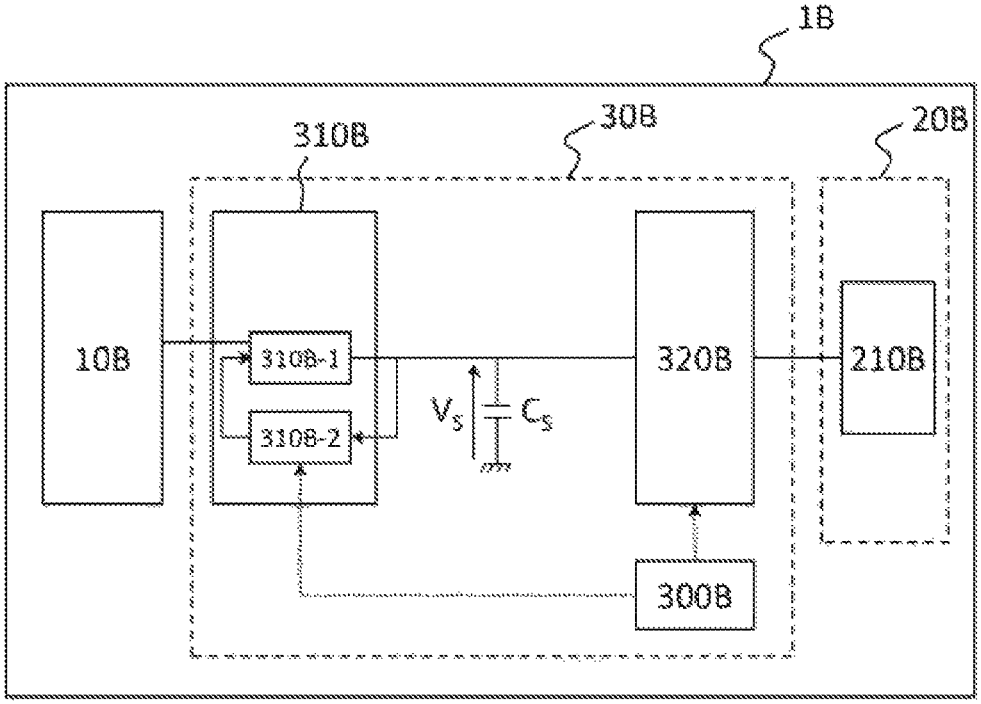
FIG. 3 schematically illustrates one embodiment of the vehicle according to the invention.

FIG. 2 shows one example of a vehicle 1B according to the invention.

I) Vehicle 1B

The vehicle 1B comprises a supply battery 10B, an engine 20B and a computer 30B for controlling said engine 20B.

1) Supply battery 10B

The supply battery 10B is an electrical energy supply battery on board the vehicle 1B for supplying power to auxiliary electrical equipment (not shown) of the vehicle 1B. The supply battery 10B delivers, for example, a DC voltage whose value may be between 6 and 24 V and that is preferably of the order of 12 V.

2) Engine 20B

The engine 20B is a thermal combustion engine comprising a plurality of cylinders (not shown) on each of which at least one fuel injector 210B is mounted.

3) Computer 30B

With continuing reference to FIG. 2, the computer 30B comprises a microcontroller 300B, a DC-to-DC voltage converter 310B and a control module 320B. The converter 310B comprises a conversion module 310B-1 and a regulation module 310B-2.

a) Microcontroller 300B

The microcontroller 300B is configured so as to control the control module 320B so that it delivers a control current to the fuel injectors 210B of the engine 20B of the vehicle 1B. To this end, the microcontroller 300B is configured so as to send an injection control signal to the control module 320B allowing said control module 320B to drive the injector(s) 210B in question for a predetermined time (by way of the microcontroller 300B) to inject fuel.

Figure 4:
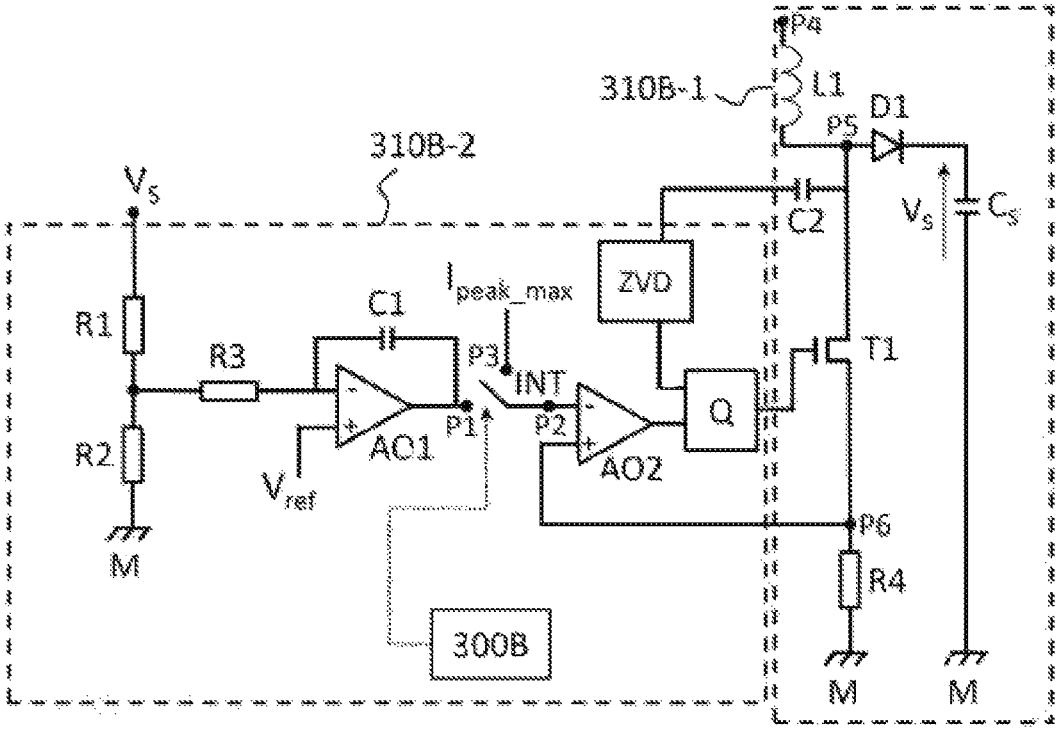
FIG. 4 schematically illustrates one embodiment of the converter according to the invention.

As illustrated in FIG. 4, the microcontroller 300B is also configured so as to send a signal to activate what is called a "forced" mode to the converter 310B.

The microcontroller 300B is also configured so as to send a deactivation signal to the converter 310B so that the converter switches from the forced mode to the regulation mode.

b) Converter 310B

The conversion module 310B-1, which is a "boost" conversion module, is configured so as to convert the DC voltage delivered by the supply battery 10B into a DC output voltage $V_S$ of higher value, defined across the terminals of what is called an "intermediate" capacitor $C_S$ connected between the converter 310B and the control module 320B. This output voltage $V_S$ varies between a minimum value and a maximum value called "target voltage", for example of the order of 60 V. The target voltage makes it possible to supply the control module 320B with a current whose strength is great enough to drive the injectors, as will be described below. The minimum output voltage value is reached following a discharge of control current into the injectors 210B.

The regulation module 310B-2 is configured so as to operate in what is called a "regulation" mode and in what is called a "forced" mode.

In the regulation mode, the regulation module 310B-2 is configured so as to regulate the output voltage $V_S$ of the converter 310B by generating a current $I_{peak}$ from the regulated output voltage V. "Regulated" is understood to mean that the output voltage $V_S$ is subjected to a fixed setpoint so as to remain as close as possible to said setpoint. In the example of the figure that will be described below, the setpoint is generated from the reference voltage $V_{ref}$ which, through the divider bridge, gives a target voltage (setpoint) of 60 V.

In this regulation mode, the regulation module 310B-2 generates, in a loop, a current whose strength may vary between a predetermined minimum value $I_{peak_min}$ and a predetermined maximum value $I_{peak_max}$.

Figure 5:
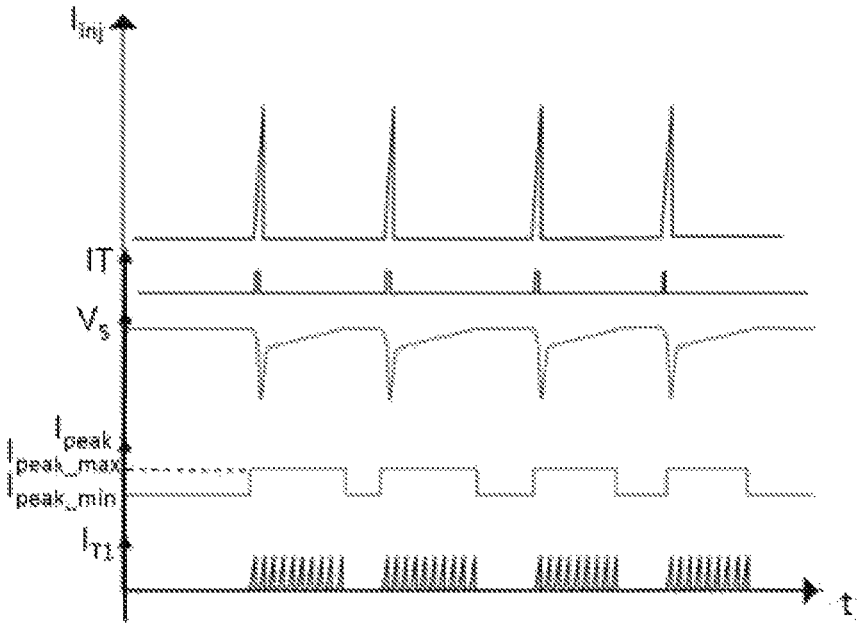
FIG. 5 graphically illustrates an example of the temporal evolution of the amplitude of the injection current $I_{inj}$, of the control times of the injection current $I_{inj}$, of the output voltage $V_S$ across the terminals of the intermediate capacitor $C_S$ and of the amplitude of the regulation current and of the amplitude of the current in a transistor of a converter in an engine control computer of the vehicle of FIG. 4.
Figure 6:
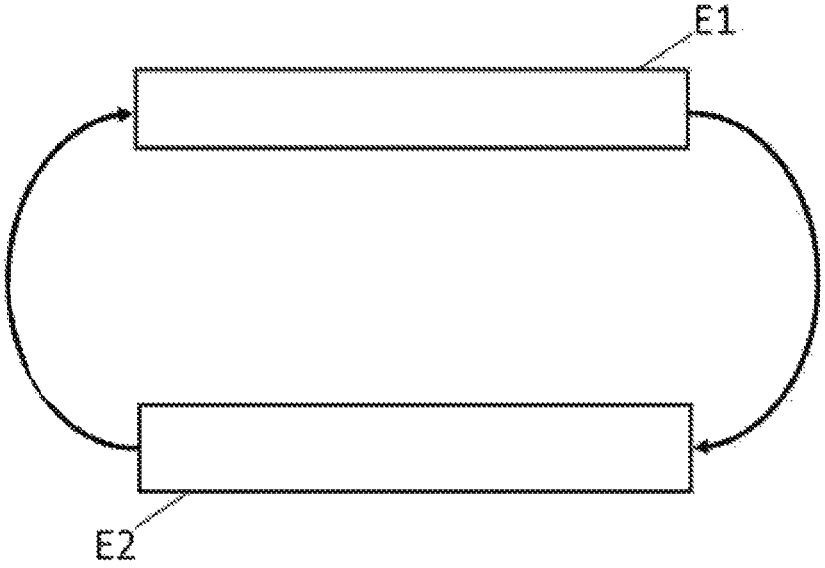
FIG. 6 schematically illustrates one mode of implementation of the method according to the invention.

In the forced mode, the regulation module 310B-2 is configured such that the converter 30B generates its own output voltage $V_S$ by setting the strength of the current to the predetermined value $I_{peak_max}$ (FIG. 5).

The converter 310B is configured so as to switch from the regulation mode to the forced mode when it is controlled by the microcontroller 300B, for example upon receiving an activation signal sent by the microcontroller 300B.

The converter 310B is configured so as to switch from the forced mode to the regulation mode upon receiving a deactivation signal sent by the microcontroller 300B or when the value of the output voltage reaches the value of the target voltage.

FIG. 4 shows one example of an electrical circuit for producing the converter 310B.

In this example, the regulation module 310B-2 comprises a voltage divider bridge, a first operational amplifier AO1, a second operational amplifier AO2, used as a comparator, a flip-flop Q (for example an RS flip-flop) and a module ZVD (zero voltage detection). Since such a flip-flop Q and such a module ZVD are known, they will not be described further here.

The voltage divider bridge consists of two resistors R1, R2 that are adjusted so that the value of the center tap corresponds to the value of the voltage $V_{ref}$ connected to the output voltage $V_S$, on the one hand, and to ground M, on the other hand, the output point of the bridge being connected to a resistor R3 that is itself connected to the negative terminal of the first operational amplifier AO1.

The positive terminal of the first operational amplifier AO1 is connected to a reference voltage $V_{ref}$, for example of the order of 1 V.

A capacitor C1 is connected between the negative terminal of the first operational amplifier AO1 and the output terminal of said first operational amplifier AO1 at a point P1.

The negative terminal of the second operational amplifier AO2 is connected to a point P2. The output terminal of the second operational amplifier AO2 is connected to a first input terminal of the flip-flop Q.

The positive terminal of the second operational amplifier AO2 is connected at a point P6 of the conversion module 310B-1.

The module ZVD is connected to the second input terminal of the flip-flop Q, on the one hand, and to a capacitor C2 of the conversion module 310B-1, on the other hand.

The output terminal of the flip-flop Q is connected to the control terminal of a transistor T1 of the conversion module 310B-1, for example the base of the transistor T1 in the case of a bipolar transistor or the gate of the transistor T1 in the case of a MOSFET transistor.

The conversion module 310B-1 comprises an inductive coil L1, connected between a point P4 that is connected to the output of the battery 10B and a point P5, a capacitor C2 that is connected to the module ZVD of the regulation module 310B-2, on the one hand, and to said point P5, on the other hand, a diode D1 that is connected to the point P5, on the one hand, and to a terminal of the intermediate capacitor $C_S$, on the other hand, the other terminal of the intermediate capacitor $C_S$ being connected to ground M. The conversion module 310B-1 then comprises a transistor T1, for example a bipolar or MOSFET transistor, the control terminal of which is connected to the output terminal of the flip-flop Q of the regulation module 310B-2, and the upper terminal of which is connected to the point P5 and the lower terminal of which is connected to a point P6 that is itself connected to the positive terminal of the second operational amplifier AO2. The conversion module 310B-1 lastly comprises a resistor R4 connected to the point P6, on the one hand, and to ground M, on the other hand.

In order to switch between the regulation mode and the forced mode and vice versa, the regulation module 310B-2 comprises a two-position switch INT comprising a fixed terminal connected to the point P2 (negative terminal of the second operational amplifier AO2) and a switchable terminal that is configured so as to switch between the point P1 and a point P3 connected to a voltage potential that makes it possible to inject a current whose strength is equal to the maximum value $I_{peak_max}$ of the regulation current $I_{peak}$. This maximum value $I_{peak_max}$ is expediently chosen to be high enough to allow the shortest possible recharging times of the intermediate capacitor $C_S$, but limited so as not to damage the components of the converter (inductive coil L1, resistor R4, transistor T1, diode D1) through an abrupt temperature increase of said components linked to Joule effect phenomena.

When the switch INT is connected between the point P1 and the point P2, the regulation module 310B-2 operates in what is called a "regulation" mode.

When the switch INT is connected between the point P3 and the point P2, the regulation module 310B-2 operates in what is called a "forced" mode.

The microcontroller 300B is configured so as to control the switch INT so that it switches between the regulation mode (switch connected between the point P1 and the point P2) and the forced mode (switch connected between the point P3 and the point P2). This control operation is achieved by the microcontroller 300B sending the conversion module 310B-2 a signal for activating the forced mode or a signal for deactivating the forced mode (that is to say for returning to the regulation mode).

c) Control Module 320

The control module 320B (commonly known under the name "driver") is configured so as to drive the opening of the injectors 2108 (the injectors 2108 being connected to the output voltage $V_S$ and to ground simultaneously) when it receives a control signal from the microcontroller 300B.

The microcontroller 300B is configured so as to simultaneously send an injection start control signal to the control module 320B, so that said control module 320B drives at least one injector 210B, and a signal for activating the forced mode to the conversion module 310B-2.

This activation signal makes it possible to switch the switch from the point P1 to the point P3 such that the negative input of the comparator is connected to a potential value that makes it possible to deliver a current whose strength is equal to the maximum value $I_{peak_max}$ on the negative input terminal of the second operational amplifier AO2, such that the converter 310B supplies its own output voltage $V_S$ independently of the voltage setpoint (Vref) by setting the strength of the regulation current to its maximum.

As soon as the output voltage $V_S$ reaches the value of the target voltage again, the switch INT switches from the point P3 to the point P1 in order to return to regulation mode. This change may advantageously take place either by sending a signal to deactivate the forced mode, delivered by the microcontroller 300B as soon as it has detected a voltage $V_S$ equal to the value corresponding to the target voltage, or internally to the converter 310B using a comparator integrated into said converter 310B (not shown).

II) Implementation

One exemplary implementation will now be described with reference to FIGS. 3 to 6.

The microcontroller 300B periodically controls the control module 320B so that it controls one or more injectors 210B.

When the microcontroller 300B does not control the control module 320B so that it controls one or more injectors 210B, the switch INT of the regulation module 310B-2 electrically connects the point P1 connected to the output terminal of the first operational amplifier AO1 and the point P2 connected to the negative input terminal of the second operational amplifier AO2 (regulation mode) so that the output voltage of the converter 310B is regulated.

With reference to FIG. 5, when fuel is to be injected, that is to say that a current is to be injected at a time IT, the microcontroller 300B simultaneously sends a control signal to the control module 320B so that it controls the corresponding injector(s) 210B, and an activation signal to the regulation module 320B-2 in order to switch the switch INT between the point P1 and the point P3. In doing so, the negative input terminal of the second operational amplifier AO2 receives a current whose strength corresponds to the maximum value $I_{peak_max}$ which then produces, as illustrated in FIG. 5, a current in the transistor T1 that makes it possible to generate a rectangular-wave regulation current $I_{peak}$ at the output of the regulation module. Switching the switch INT from the point P1 to the point P3 makes it possible to switch the converter 30B from the regulation mode to the forced mode in a step E1.

When the injection phase stops, the output voltage $V_S$ (having previously dropped) increases rapidly by virtue of the driving of the regulation module 310B-2 at the maximum value $I_{peak_max}$. As soon as the output voltage $V_S$ reaches the value of the target voltage again, the microcontroller 300B detects this and sends an activation signal to the regulation module 320B-2 in order to switch the switch INT between the point P3 and the point P1 such that the negative input terminal of the second operational amplifier AO2 receives a current whose strength will result from the voltage $V_S$ regulation. Switching the switch INT from the point P3 to the point P1 makes it possible to switch the converter 30B from the forced mode to the regulation mode in a step E2. In the example of FIG. 5, the current supplied by the regulation loop in the regulation mode is equal to zero, the output voltage $V_S$ being regulated to the target voltage at the end of the forced mode.

As illustrated in FIG. 5, injecting a current $I_{peak}$ at the maximum regulation strength ($I_{peak_max}$) as soon as the control module 320B is controlled makes it possible to quickly compensate the drop in the output voltage $V_S$ of the converter 310B. In other words, at each injection peak of the injection current regulating the conversion module 320B-1 at maximum current $I_{peak_max}$ makes it possible to limit the drop in output voltage $V_S$, which is then less significant than with the prior art solution illustrated in FIG. 2.

The invention claimed is:

1. A method for regulating a DC output voltage of a DC-to-DC voltage converter of a control computer of an engine of a motor vehicle, said control computer including a microcontroller, the DC-to-DC voltage converter, a control module, and an intermediate capacitor between the DC-to-DC voltage converter and the control module, the DC-to-DC voltage converter including a conversion module connected to a regulation module, said DC-to-DC voltage converter being configured to convert a DC supply voltage delivered by a supply battery of the motor vehicle into the DC output voltage of higher value than the DC supply voltage and regulate said DC output voltage through a current loop via the regulation module and the conversion module of the DC-to-DC voltage converter, the current loop having a regulation current varying between a first predetermined value and a second predetermined value higher than the first predetermined value in a regulation mode, the second predetermined value being a value resulting in shortest recharging times of the intermediate capacitor without damaging components of the DC-to-DC voltage converter, said method comprising:

simultaneously controlling, by the microcontroller, the control module, so that said control module drives at least one injector of the engine, and the DC-to-DC voltage converter, so that said DC-to-DC voltage converter regulates the DC output voltage using the regulation module by setting a strength of the regulation current to the second predetermined value in a forced mode.

2. The method as claimed in claim 1, wherein the simultaneously controlling the control module and the DC-to-DC converter comprises simultaneously sending, by the microcontroller, a control signal to the control module, so that said control module drives the at least one injector, and an activation signal to the DC-to-DC voltage converter so that said DC-to-DC voltage converter switches to the forced mode.

3. The method as claimed in claim 2, wherein reception of the activation signal by the DC-to-DC voltage converter triggers switching of a switch in order to switch the DC-to-DC voltage converter from the regulation mode to the forced mode.

4. The method as claimed in claim 2, further comprising sending, by the microcontroller, a deactivation signal to the DC-to-DC voltage converter so that said DC-to-DC voltage converter switches from the forced mode to the regulation mode.

5. The method as claimed in claim 3, further comprising sending, by the microcontroller, a deactivation signal to the DC-to-DC voltage converter so that said DC-to-DC voltage converter switches from the forced mode to the regulation mode.

6. The method as claimed in claim 1, further comprising sending, by the microcontroller, a deactivation signal to the DC-to-DC voltage converter so that said DC-to-DC voltage converter switches from the forced mode to the regulation mode.

7. The method as claimed in claim 6, wherein reception of the deactivation signal by the DC-to-DC voltage converter triggers switching of a switch in order to switch the DC-to-DC voltage converter from the forced mode to the regulation mode.

8. The method as claimed in claim 1, wherein the DC output voltage is subjected to a setpoint voltage in the regulation mode and the DC-to-DC voltage converter regulates the DC output voltage independently of the setpoint voltage in the forced mode.

9. A control computer for an engine of a motor vehicle, the control computer comprising:

a microcontroller;

a control module;

a DC-to-DC voltage converter including a conversion module connected to a regulation module, the DC-to-DC voltage converter being configured to convert a DC supply voltage delivered by a supply battery of the motor vehicle into a DC output voltage of higher value than the DC supply voltage and to regulate said DC output voltage through a current loop via the regulation module and the conversion module of the DC-to-DC voltage converter, the current loop having a regulation current varying between a first predetermined value and a second predetermined value higher than the first predetermined value in a regulation mode such that the DC output voltage is subjected to a setpoint voltage; and an intermediate capacitor between the DC-to-DC voltage converter and the control module, wherein the second predetermined value is a value resulting in shortest recharging times of the intermediate capacitor without damaging components of the DC-to-DC voltage converter, and wherein the microcontroller is configured to simultaneously control:

the control module, so that said control module drives at least one injector of the engine, and the DC-to-DC voltage converter, so that said DC-to-DC voltage converter generates the DC output voltage independently of the setpoint voltage using the regulation module by setting a strength of the regulation current to the second predetermined value in a forced mode.

10. The control computer as claimed in claim 9, wherein the microcontroller is configured to simultaneously send a control signal to the control module, so that said control module drives the at least one injector, and an activation signal to the DC-to-DC voltage converter so that said DC-to-DC voltage converter switches to the forced mode.

11. The control computer as claimed in claim 10, wherein the microcontroller is configured to send a deactivation signal to the DC-to-DC converter so that said DC-to-DC converter switches from the forced mode to the regulation mode.

12. The control computer as claimed in claim 9, wherein the microcontroller is configured to send a deactivation signal to the DC-to-DC converter so that said DC-to-DC converter switches from the forced mode to the regulation mode.

13. The control computer as claimed in claim 12, wherein the DC-to-DC converter comprises a two-position switch configured to switch between the regulation mode and the forced mode, the microcontroller being configured to control said two-position switch so that the DC-to-DC converter switches between the regulation mode and the forced mode.

14. The control computer as claimed in claim 9, wherein the DC output voltage is subjected to a setpoint voltage in the regulation mode and the DC-to-DC voltage converter regulates the DC output voltage independently of the setpoint voltage in the forced mode.

15. A motor vehicle comprising:

an engine; and a control computer for the engine, the control computer including a microcontroller, a control module, a DC-to-DC voltage converter including a conversion module connected to a regulation module, the DC-to-DC voltage converter being configured to convert a DC supply voltage delivered by a supply battery of the motor vehicle into a DC output voltage of higher value than the DC supply voltage and to regulate said DC output voltage through a current loop via the regulation module and the conversion module of the DC-to-DC voltage converter, the current loop having a regulation current varying between a first predetermined value and a second predetermined value higher than the first predetermined value in a regulation mode such that the DC output voltage is subjected to a setpoint voltage, and an intermediate capacitor between the DC-to-DC voltage converter and the control module, wherein the second predetermined value is a value resulting in shortest recharging times of the intermediate capacitor without damaging components of the DC-to-DC voltage converter, wherein the microcontroller is configured to simultaneously control:

the control module, so that said control module drives at least one injector of the engine, and the DC-to-DC voltage converter, so that said DC-to-DC voltage converter generates the DC output voltage independently of the setpoint voltage using the regulation module by setting a strength of the regulation current to the second predetermined value in a forced mode.

16. The motor vehicle as claimed in claim 15, wherein the DC output voltage is subjected to a setpoint voltage in the regulation mode and the DC-to-DC voltage converter regulates the DC output voltage independently of the setpoint voltage in the forced mode.

* * * * *